United States Patent [19]

Frye

[11] 4,410,315

[45] Oct. 18, 1983

[54] LOW VELOCITY TRIM REMOVAL MEANS AND METHOD

[75] Inventor: Kenneth G. Frye, Egremont, Mass.

[73] Assignee: Beloit Corporation, Beloit, Wis.

[21] Appl. No.: 193,821

[22] Filed: Oct. 3, 1980

[51] Int. Cl.[3] ..... B31B 1/18

[52] U.S. Cl. ..... 493/342; 83/98; 83/101; 83/112; 493/373; 493/418; 493/461; 493/464

[58] Field of Search ..... 493/342, 373, 82, 83, 493/461, 464, 418, 450; 83/102, 105, 107, 110, 112, 98, 163, 165, 167, 500, 923, 101

[56] References Cited

U.S. PATENT DOCUMENTS

| | | | |
|---|---|---|---|
| 2,084,967 | 6/1937 | Babb | 83/163 X |
| 2,133,595 | 10/1938 | Thomas | 83/110 X |
| 3,069,949 | 12/1962 | Cooley | 83/923 X |
| 3,252,366 | 5/1966 | Karr | 83/102 X |
| 3,398,223 | 8/1968 | Schatz et al. | 493/464 X |
| 3,465,625 | 9/1969 | Daly | 83/105 X |
| 3,713,358 | 1/1973 | Honeycutt et al. | 83/167 X |
| 4,082,259 | 4/1978 | Anderson | 493/450 X |
| 4,231,272 | 11/1980 | Crouse | 83/98 |

*Primary Examiner*—James F. Coan

*Attorney, Agent, or Firm*—Hill, Van Santen, Steadman & Simpson

[57] ABSTRACT

A means and method for handling trim strip slit from the margin of a travelling web, comprising rotary means by which biasing forces is applied to the strip away from the slitter into the chute. Within the chute relatively low velocity means advance the trim strip in a foldably bunched condition toward the bottom of the chute where the bunched trim strip is then transported away from the chute. Low velocity air, as well as rotary members are provided in the chute for effecting the foldable bunching and advancing of the trim strip. Either or both of low velocity air and mechanical conveying apparatus may be provided for transporting the trim strip away from the bottom of the chute.

34 Claims, 6 Drawing Figures

FIG. 2
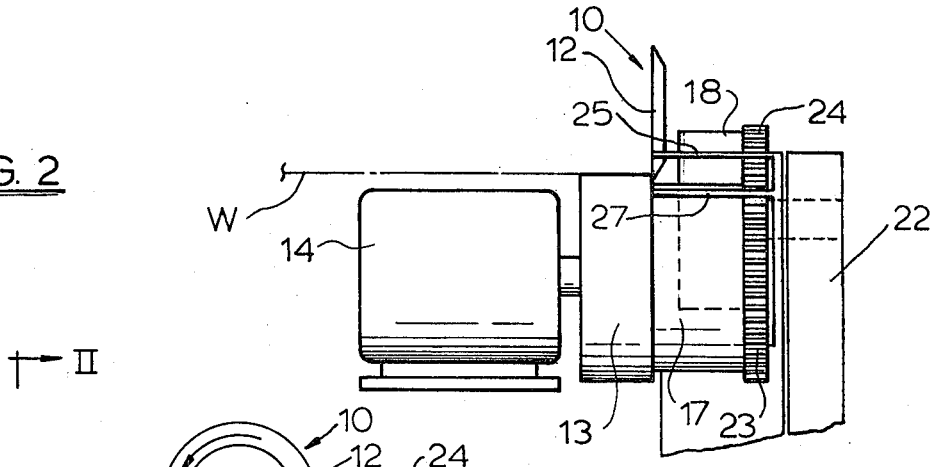
FIG. 1
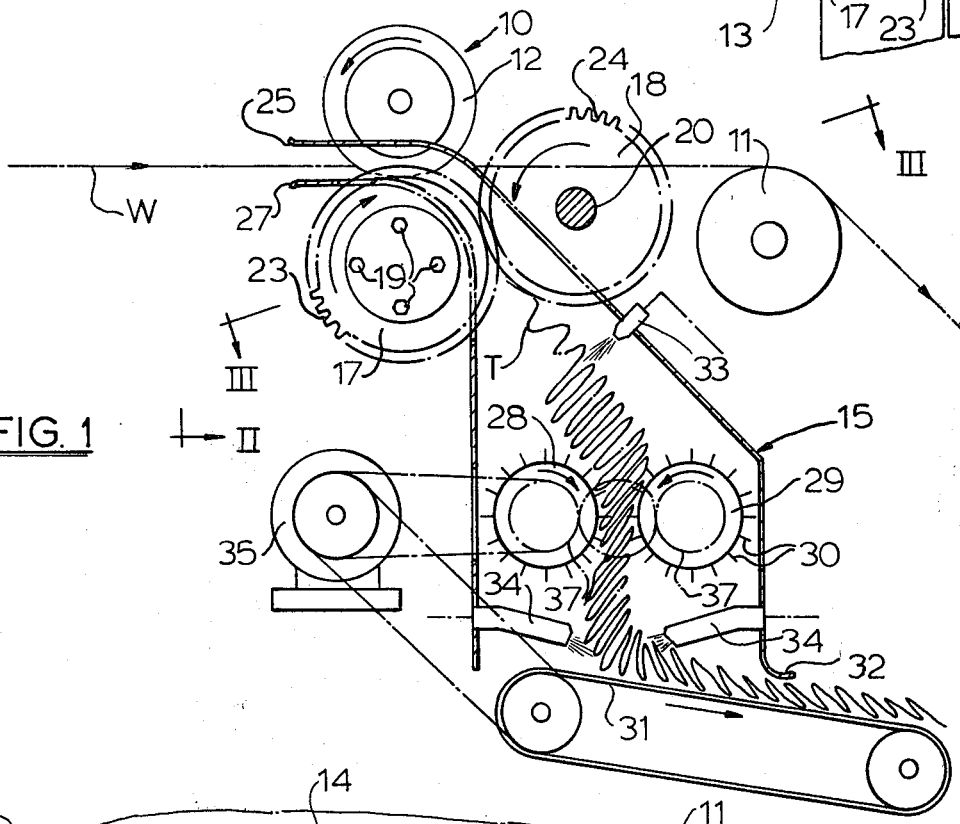
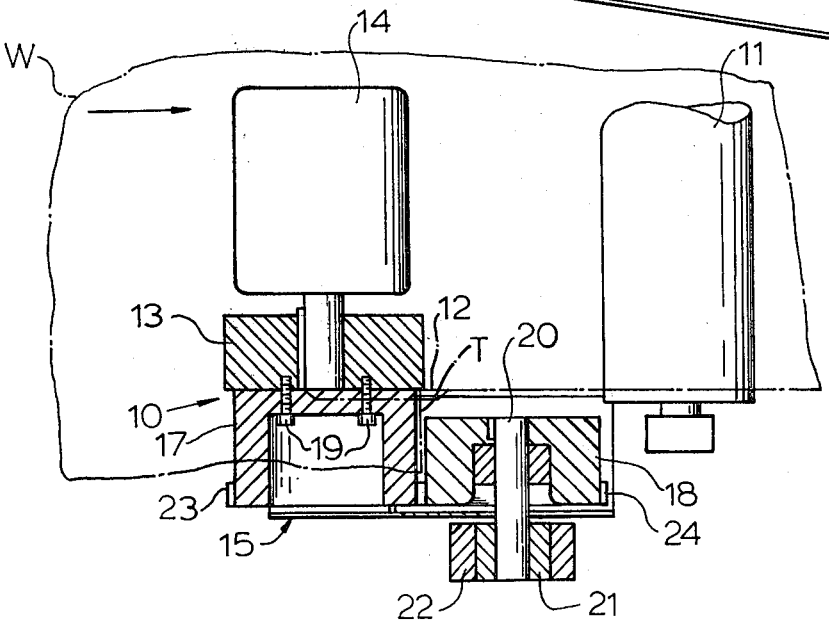
FIG. 3

LOW VELOCITY TRIM REMOVAL MEANS AND METHOD

This invention relates to improvements in the handling of trim strip severed by a slitter from the margin of a travelling web.

Trim slitters commonly embody an upper slitter knife and a lower slitter band and means for handling the strip trimmed from the margin of the travelling web.

A fairly successful device for handling the trim strip is disclosed in Karr U.S. Pat. No. 3,252,366, according to which the trim strip is received in a chute and assisted in travel away from the slit by means of high velocity air jets directly impinging the strip at spaced intervals longitudinally from the chute wall underlying the strip as the strip passes obliquely downwardly in the chute. When the air velocity relative to speed of travel of the trim strip is carefully regulated and maintained in proper adjustment, the apparatus of the patent functions acceptably. However, the system is susceptible of maladjustment due to improper or inexperienced or careless attention or maintenance, and the air pressure may be too high or too low or may be permitted to fluctuate undesirably. Sometimes, hang-up of the trim strip has occurred, and improper adjustment may result in flutter with attendant noise and likelihood of at least whipping against the opposite side of the chute from that at which the high velocity air jets are released toward the strip.

Whether with the system of the identified patent, or other trim systems involving flowing high velocity air, it is necessary to maintain the air velocity at the trim intake or along the path of the trim at two or three times the speed of travel of the web from which the trim has been severed by the slitter, in order to keep the trim from backing up at the slitter. This air velocity in addition to being costly, creates an objectionable amount of noise.

Accordingly, it is a principal object of the present invention to oercome the problems encountered in prior trim removal systems and to provide a new and improved means for and method of removing trim from a slitter.

Another object of the invention is to provide a new and improved low velocity trim removal means and method, wherein the trim is adapted to be taken from the slitter at the speed of travel of the web from which the trim has been removed and continuously advanced through a trim chute at relatively low velocity, efficiently and substantially noise free or at least at such a low noise level as to be unobjectionable.

The invention provides in combination with a slitter for marginally trimming a strip of material from a travelling web, and a trim chute extending angularly away from the slitter for receiving the trim strip, rotary means cooperatively related to said slitter for receiving the trim strip therebetween and turning and biasing the trim strip from the slitter into the chute at substantially the speed of travel of said web, and means in said chute for advancing the trim strip in the chute at a relatively lower velocity than said speed of travel. A method utilizing such apparatus is also provided.

The invention also provides in a trim chute assembly adapted for receiving and removing trim strip from a travelling web, means for directing the trim strip into the chute, and opposed members located within the chute and operatively driven rotatably with the trim strip therebetween for advancing the strip through the trim chute. A method utilizing this apparatus is also provided.

There is also provided by the present invention a trim chute for handling marginal strip trimmed from a travelling web, and comprising means for diverting the trim strip into the chute, and means within the chute for bunching the trim strip generally foldably and advancing the bunched trim strip through the chute. A method which may utilize such apparatus is also provided.

This invention also provides in combination with a slitter for marginally trimming a strip of material from a travelling web, and a trim chute extending angularly away from the slitter for receiving the trim strip, rotary members cooperatively related to said slitter for receiving the trim strip from the slitter and turning and biasing the trim strip from the slitter into the chute at substantially the speed of travel of said web, said rotary members having their surfaces related for applying frictional and air biasing components of force in the direction of travel of the trim strip without applying possibly tearing pull on the strip.

Also provided by the present invention is a method of removing from a slitter a marginal strip trimmed from a travelling web, comprising operating rotary members adjacent to the slitter and thereby applying biasing force to the trim strip in a direction away from the slitter and into a trim chute at substantially the speed of travel of said web, and relating the surfaces of said rotary members for appyling frictional and air biasing components of force to the strip in the direction of travel of the strip without applying possibly tearing pull on the strip.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a schematic side elevational view showing a web trimming and chute assembly embodying the invention;

FIG. 2 is a fragmentary elevational view taken substantially in the plane of line II—II of FIG. 1;

FIG. 3 is a sectional plan view taken substantially along the line III—III of FIG. 1;

Figure 4:
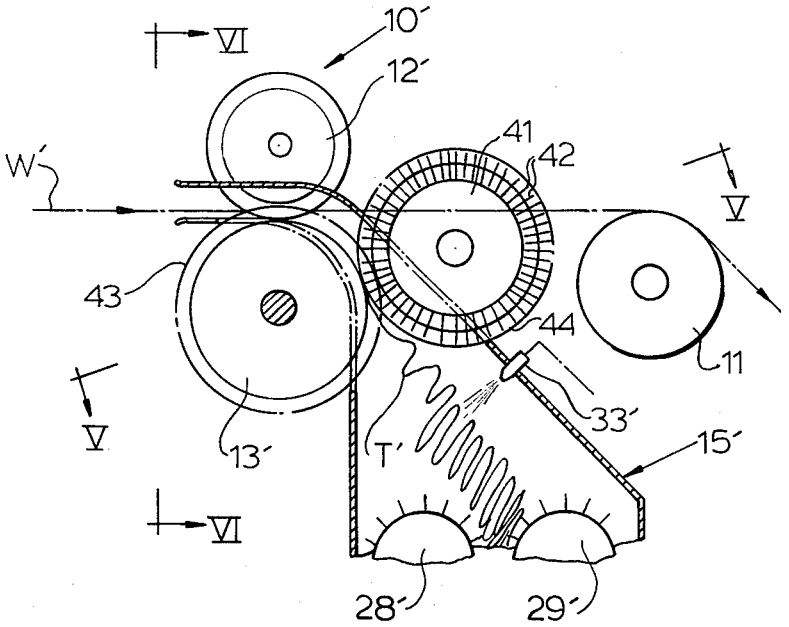
FIG. 4 is a schematic side elevational view partially in section, showing a modification.

A slitter 10 (FIG. 1) is adapted for trimming a marginal strip T from a travelling web W such as paper. The web W may travel at a fairly high rate of speed, and after the slitter 10 may pass over a guide roller 11 to a winder or other processing equipment (not shown) of any desirable form. The slitter 10 comprises a rotary slitter blade or knife 12 with which is cooperatively related a lower slitter band 13 (FIGS. 2 and 3) which may conveniently be driven by means such as a motor 14. It will be understood that suitable table support for the web W in the vicinity of the slitter 10 will be provided and that the other structure including the motor 14 will be supported on adequate supporting structure. Such supporting structures are not shown since they are conventional and not essential to a full understanding of the present invention.

A trim chute 15 is cooperatively related to the slitter 10 for receiving the trim strip T, and new and improved means are provided for handling the trim strip from adjacent to the point where it leaves the slitter blade 11 and on through the chute 15 in an efficient, positive and substantially quiet manner. To this end there is associated with the slitter 10 rotary means for biasing the trim strip from the slitter into the chute 15, such means operating at a speed substantially faster than the speed of travel of the web. In the arrangement shown, wherein the slitter band 13 serves to support the web as the slitter blade 12 functions to trim the strip T from the web, a biasing force is applied to the strip by and between a trim take-away wheel assembly comprising a trim receiving wheel 17 and a trim directing wheel 18. These wheels have annular drum surfaces which are so related in non-nipping relation that they provide maximum trim stability in changing direction of trim where the velocity of the process is such that the trim does not want to change direction. Conveniently, the receiving wheel 17 is co-rotatively supported by the slitter band 13 either as a monolithic part therewith or, as shown, as a separately formed drum-like wheel of adequate width to accommodate the strip T and secured to the outer face of the slitter band 13 as by means of screws 19.

Desirably, the directing wheel 18 is rotatably supported as by means of an idler shaft 20 carried by a bearing 21 on a suitable support 22 and in a position to be driven by the wheel 17 or by other means. Conveniently, a driving connection between the wheels 17 and 18 may be effected by means of cooperating gear teeth 23 on the outer end portion of the wheel 17 and meshing gear teeth 24 on the corresponding end portion of the wheel 18, and with the major area of the cooperating perimeters of the wheels free from the teeth 23 and 24 for receiving the strip T therebetween. The arrangement is such that there is a gap between the wheels 17 and 18 where they would otherwise nip so that although the strip T is effectively guided between the wheels, there is no direct nipping engagement and pull on the strip. Nevertheless, rotation of the wheels applies a sufficient tension on the strip T to effect positive advance of the strip away from the slitter 10 into the chute 15. Action of the wheels 17 and 18 is enhanced by a sufficient diametrical differential between the wheels themselves and relative to the slitter band 13 to run at 5% to 10% faster than the speed of travel of the web W, so that a frictional and air drag bias will be applied to the strip T by the overspeed. In a practical arrangement, the biasing gap between the opposed functioning points on the peripheries of the wheels 17 and 18 may be on the order of 1/32 of an inch. By avoiding direct contact of the trim strip T by a roll nip, undesirable tension is avoided on the strip relative to the web W, while nevertheless advance of the strip away from the slitter biade 12 and into the trim chute 15 is positive and efficient.

To assure initial guidance of the trim strip T towards the opposed peripheral functioning points of the wheels 17 and 18, the upper end of the generally downwardly directed trim chute 15 has infeed upper and lower guide flanges 25 and 27, respectively, providing spaced guide lips into the throat of the chute 15 aligned with the strip biasing gap between the wheels 17 and 18. Beyond the biasing gap, the walls defining the front and rear of the chute 15 flare in a front to rear direction to accommodate relatively low velocity means in the chute for advancing the trim strip in the chute.

In a preferred arrangement, the low velocity advancing means comprise opposed operatively driven rotary members 28 and 29 disposed on parallel axes in or nearly a substantially horizontal plane. One or both of the members 28 and 29 may be in the form of a spring loaded wheel or in the form of a hub or roll of desirable diameter carrying generally radially extending spikes or stiff bristles 30 which cooperate at the nearest approach of the spaced peripheries of the rotary members to loosely engage and advance the strip T downwardly within the chute 15. Rotary operation of the strip advancing roll members 28 and 29 is desirably effected at a speed differential slightly slower than the speed of travel of the web W to cause the strip T to bunch foldably ahead of the members 28 and 29. The foldably bunched strip is then advanced toward the bottom of the chute 15 and may, as shown, be removed on an endless conveyor 31, being transported from the chute under an outlet guide flange 32 coverging toward the conveyor 31 in substantially spaced relation. In order to assist in folding the strip T above the members 28 and 29, a low velocity air nozzle 33 may be provided to drive folding air in a generally downwardly and rearwardly oblique direction toward the strip T. The active setting of the members 28 and 29 is desirably offset relative to the biasing gap between the wheels 17 and 18 in a forward direction, substantially as seen in FIG. 1, whereby to facilitate the strip folding bunching coaction of the members 28 and 29 and the air nozzle 33 which blows the air generally perpendicularly to the trim flow direction whereby to encourage folding of the trim. Although gravity delivery of the trim strip from the members 28 and 29 to the conveyor 31 may be relied on, positive advance of the strip to the conveyor may be encouraged by means of low velocity air, such as may be delivered from suitably positioned air nozzles 34. Where mere downward dumping of the trim strip from the chute 15 is desired, simple gravity discharge or low velocity air assisted discharge may be effected. Relatively low velocity air for the nozzles 33 and 34 may be provided from a common source, and suitable control for differential velocity between the nozzle 33 and nozzle 34 may be effected in known manner, if desired. In any event, the air delivered from the nozzles 33 and 34 will be at low enough velocity to avoid undesirable air created noise within the chute 15. Although the endless conveyor 31 is for illustrative purposes depicted as oriented in a generally forward direction, it will be understood that for practical reasons it may have to be in a direction perpendicular to the direction of travel of the web W.

Figure 5:
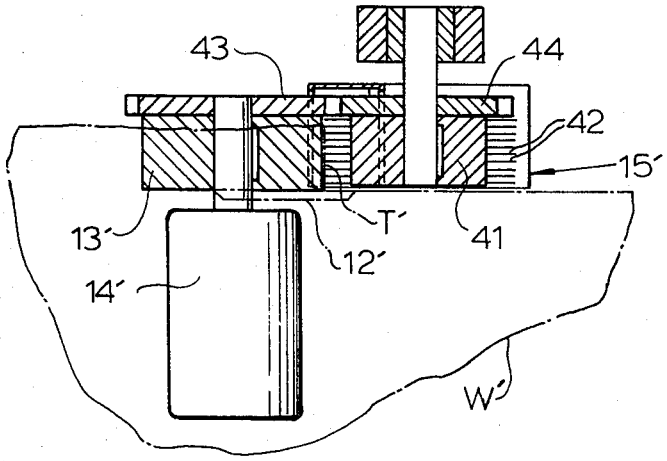
FIG. 5 is a sectional plan view taken substantially along the line V—V of FIG. 4.
Figure 6:
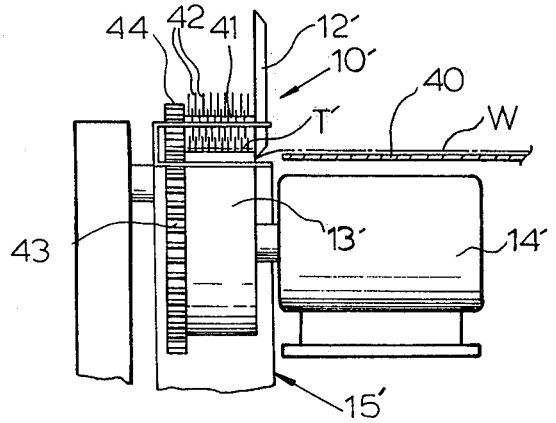
FIG. 6 is an elevational view taken substantially in the plane of line VI—VI of FIG. 4.

Driving of the spike members 28 and 29 in unison from a common power source, such as a motor 35 may be effected by means of a gear train 37. The motor 35 may also drive the conveyor 31, as shown.

Where more positive biasing of the trim strip away from the slitter blade may be desired for at least certain grades of paper web or the like, the arrangement depicited in FIGS. 4–6 may be employed. Although the trim chute 15', the air nozzle 33' and the trim bunching and advancing rolls 28' and 29', as well as other features in and associated with operation of, and located in the trim chute 15', may be substantially the same as already described in respect to FIGS. 1–3, in the modified arrangement the web W' adjacent to the slitter assembly 10', and more particularly the slitter blade 12' is supported by a table 40. The slitter band 13' serves as receiving wheel means for the severed trimmed strip T' and serves together with a knockdown or rotary directing wheel brush 41 as rotary means associated with the slitter for applying a rotary force biasing the trim strip away from the slitter 10' at substantially the speed of travel of the web W' into the chute 15'. The brush roll 41 has its perimeter in substantial spaced relation to the perimeter of the slitter band wheel 13', and radially extending bristles 42 on the perimeter of the roll 41 are of a length to effect contact with an apply slipping biasing force to the strip T' travelling on the perimeter of the band 13' away from the point of slitting of the trim strip from the web W'. The biasing forces provided by brush roll 41 are such as to give maximum web stability without breaking the trim strip at the slitter.

Positive biasing of the web strip by the bristles 42 is assured by overdrive of the roll 41 relative to the speed of travel of the web W', by having the drive for the roll 41 related in 5–10% overdrive relation to the trim band 13' which is driven by the motor 14' at substantially the same speed as travel of the web W'. For this purpose, a drive gear 43 co-rotative with the slitter band 13' is differentially larger than a driven gear 44 meshing therewith and co-rotative with the roll 41. It will be understood, of course, that the bristles 42 will be stiff enough for the intended purpose, but of soft enough or yieldable enough character to avoid tearing the trim strip T', so that although constant biasing tension is applied to the trim strip, it will not be torn and thus tend to clog the slitter 10'. After the trim strip T' has been biased into the trim chute 15', it is desirably acted upon in the manner described in connection with the chute 15 by the relatively low velocity means including the spike rolls 28' and 29' and the low velocity air delivered by the nozzle 33' for advancing the trim strip in the chute.

It will be understood that variations and modifications may be effected without departing from the spirit and scope of the novel concepts of this invention.

I claim as my invention:

1. In combination with a slitter for marginally trimming a strip of material from a travelling web, and a trim chute extending angularly away from the slitter for receiving the trim strip:

rotary means cooperatively related to said slitter for receiving the trim strip therebetween and turning and biasing the trim strip from the slitter into the chute at substantially the speed of travel of said web;

and means in said chute for advancing the trim strip in the chute at a relatively lower velocity than said speed of travel;

said rotary means comprising annular drum surfaces spaced apart sufficiently to avoid nipping the trim strip but close enough for applying rotary frictional and air biasing components of force in the direction of travel of the trim strip.

2. A combination according to claim 1, wherein one of said rotary surfaces comprises a receiving surface to receive the trim strip from the slitter, and means for driving the other of said surfaces at a greater surface speed than said receiving surface.

3. In combination with a slitter for marginally trimming a strip of material from a travelling web, and a trim chute extending angularly away from the slitter for receiving the trim strip:

rotary means cooperatively related to said slitter for receiving the trim strip therebetween and turning and biasing the trim strip from the slitter into the chute at substantially the speed of travel of said web;

and means in said chute for advancing the trim strip in the chute at a relatively lower velocity than said speed of travel;

said rotary means comprising wheels, at least one of which has generally radially extending bristles for engaging and assisting in biasing the trim strip.

4. In combination with a slitter comprising a slitter blade and a cooperating slitter band for marginally trimming a strip of material from a travelling web, and a trim chute extending angularly away from the slitter for receiving the trim strip:

rotary means cooperatively related to said slitter for receiving the trim strip therebetween and turning and biasing the trim strip from the slitter into the chute at substantially the speed of travel of said web;

said rotary means comprising a receiving wheel co-rotative with said slitter band and a trim directing wheel having its periphery in closely spaced relation to the periphery of said receiving wheel and defining a trim strip biasing gap through which the trim strip is biased away from the point of slitting of the web by the blade and the slitter band;

and means in said chute for advancing the trim strip in the chute at a relatively lower velocity than said speed of travel.

5. A combination according to claim 4, wherein said wheels are geared together for unison rotation.

6. In combination with a slitter for marginally trimming a strip of material from a travelling web, and a trim chute extending angularly downwardly away from the slitter for receiving the trim strip:

rotary means cooperatively related to said slitter for receiving the trim strip therebetween and turning and biasing the trim strip from the slitter into the chute at substantially the speed of travel of said web;

means in said chute for advancing the trim strip in the chute at a relatively lower velocity than said speed of travel;

and means for transporting the trim strip away from below said low velocity means;

said transporting means comprising low velocity air directing means.

7. A method of removing from a slitter a marginal strip trimmed from a travelling web, comprising:

operating rotary members adjacent to the slitter and thereby applying biasing force to the trim strip in a direction away from the slitter and into a trim chute at substantially the speed of travel of said web;

and relating the surfaces of said rotary members for applying frictional and air biasing components of force to the strip in the direction of travel of the strip without applying possibly tearing pull on the strip.

8. A method according to claim 7, comprising running said trim strip between non-nipping drum surfaces of said rotary members.

9. A method according to claim 8, which comprises receiving the trim strip from the slitter on one of said drum surfaces, and driving the other of said drum surfaces at a greater surface speed than the receiving surface.

10. A method according to claim 7, which comprises providing one of said rotary members with generally radially extending bristles, and by action of said bristles assisting in said biasing of the trim strip.

11. A method of removing from a slitter a marginal strip trimmed from a travelling web, comprising:

operating a rotary device adjacent to the slitter and thereby applying biasing force to the trim strip in a direction away from the slitter and into a trim chute at substantially the speed of travel of said web;

within the trim chute advancing the trim strip at a lower velocity than said speed of travel;

folding and bunching the trim strip in said chute in the course of advancing the trim strip at said lower velocity;

and impinging said trim strip with low velocity air for promoting said folding and bunching.

12. A method of removing trim strip from a travelling web into a trim chute assembly, comprising:

directing the trim strip from a slitter into the trim chute assembly;

advancing the trim strip through the trim chute assembly between opposed rotary members located within said chute assembly a substantial distance beyond said slitter;

and driving said members rotatably at a slower speed than the speed of travel of said web, and thereby promoting bunching of the trim strip within the chute in the space between said slitter and said rotary members.

13. A method according to claim 12, including impinging said trim strip with low velocity air for promoting said bunching.

14. A method of removing from a slitter a marginal strip trimmed from a travelling web, comprising:

operating a rotary device adjacent to the slitter and running said trim strip between non-nipping drum surfaces of said rotary device and by means of said drum surfaces applying rotary frictional and air biasing components of force to the trim strip in a direction away from the slitter and into a trim chute at substantially the speed of travel of said web;

and within the trim chute advancing the trim strip at a lower velocity than said speed of travel.

15. A method according to claim 14, including transporting the trim strip from the bottom of said chute.

16. A method according to claim 14, which comprises receiving the trim strip from the slitter on one of said drum surfaces, and driving the other of said surfaces at a greater surface speed than the receiving surface.

17. A method according to claim 14, comprising in said chute folding and bunching the trim strip in the course of advancing the trim strip at said lower velocity.

18. A method according to claim 17, including impinging said trim strip with low velocity air for promoting said folding and bunching.

19. A method according to claim 14, including controlling advance of the trim strip at said lower velocity by running the strip between rotary members rotating at a slower speed than the speed of travel of said web and thereby promoting foldable bunching of the trim strip in the chute.

20. In a trim chute assembly adapted for receiving and removing trim strip from a travelling web:

means for directing the trim strip into the chute;

and opposed cooperating spike rolls located within said chute and operatively driven rotatably with the trim strip therebetween for advancing the strip through the trim chute.

21. A trim chute according to claim 20, including means for driving said rolls at a relatively slower speed than said web, whereby to promote bunching of the trim strip in the chute.

22. A trim chute for handling marginal strip trimmed from a travelling web, and comprising:

means for diverting the trim strip into the chute;

and means within the chute for bunching the trim strip generally foldably and advancing the bunched trim strip through the chute and comprising air nozzle means for directing low velocity air toward and onto the trim strip within the chute.

23. A trim chute according to claim 22, wherein said means for foldably bunching include opposed rotary members and means for driving said rotary members at a slower speed than the speed of travel of said web.

24. A trim chute according to claim 23, wherein said rotary members comprise cooperating spike rollers.

25. A method of handling marginal strip trimmed from a travelling web, comprising:

diverting the trim strip into a chute;

and within the chute bunching the trim strip generally foldably by impinging low velocity air against the trim strip and advancing the bunched trim strip through the chute.

26. A method according to claim 25, including, in addition, running the trim strip between cooperating rotary members, and driving said rotary members at a speed slower than the speed of travel of said web.

27. A method according to claim 25, comprising further effecting said foldably bunching by running the trim strip in the chute between rotary members rotating at a speed less than the speed of travel of said web.

28. In combination with a slitter for marginally trimming a strip of material from a travelling web, and a trim chute extending angularly away from the slitter for receiving the trim strip:

rotary members cooperatively related to said slitter for receiving the trim strip from the slitter and turning and biasing the trim strip from the slitter into the chute at substantially the speed of travel of said web;

said rotary members having their surfaces related for applying frictional and air biasing components of force in the direction of travel of the trim strip without applying possibly tearing pull on the strip.

29. A combination according to claim 28, wherein said rotary members comprise annular drum surfaces spaced apart sufficiently to avoid nipping the trim strip but close enough for applying rotary frictional and air biasing components of force in the direction of travel of the trim strip.

30. A combination according to claim 29, wherein one of said rotary surfaces comprises a receiving surface to receive the trim strip from the slitter, and means for driving the other of said surfaces at a greater surface speed than said receiving surface.

31. A combination according to claim 28, wherein said rotary members comprise wheels, at least one of which has generally radially extending bristles for engaging and assisting in biasing the trim strip.

32. In combination with a slitter for marginally trimming a strip of material from a travelling web, and a trim chute extending angularly away from the slitter for receiving the trim strip:

rotary means cooperatively related to said slitter for receiving the trim strip therebetween and turning and biasing the trim strip from the slitter into the chute at substantially the speed of travel of said web;

means in said chute for advancing the trim strip in the chute at a relatively lower velocity than said speed of travel;

said relatively low velocity advancing means comprising rotary members in said chute and spaced a substantial distance from said rotary means for receiving the trim strip therebetween;

and means for driving said rotary members at a slower speed than the speed of travel of said web for retarding the speed of advance of the trim strip, so that foldable bunching of the trim strip is promoted in the space within said chute between said rotary means and said rotary members.

33. A combination according to claim 32, wherein said relatively low velocity means in said chute additionally comprises air impingement means for assisting in said foldable bunching of the trim strip in the chute.

34. A combination according to claim 32, wherein said rotary members comprise cooperating spike rolls.

* * * * *